US009631904B2

(12) United States Patent
Cesternino

(10) Patent No.: US 9,631,904 B2
(45) Date of Patent: Apr. 25, 2017

(54) DYNAMIC GROUP TARGET STAND

(71) Applicant: Joseph M. Cesternino, Ghent, NY (US)

(72) Inventor: Joseph M. Cesternino, Ghent, NY (US)

( * ) Notice: Subject to any disclaimer, the term of this patent is extended or adjusted under 35 U.S.C. 154(b) by 160 days.

(21) Appl. No.: 14/670,302

(22) Filed: Mar. 26, 2015

(65) Prior Publication Data

US 2015/0276356 A1 Oct. 1, 2015

Related U.S. Application Data

(60) Provisional application No. 61/971,984, filed on Mar. 28, 2014.

(51) Int. Cl.
*F41J 1/10* (2006.01)
*F41J 9/02* (2006.01)

(52) U.S. Cl.
CPC .. *F41J 1/10* (2013.01); *F41J 9/02* (2013.01)

(58) Field of Classification Search
CPC ..... F41J 1/10; F41J 9/02
USPC ..... 273/370, 388, 391, 407, 121 A; 473/556
See application file for complete search history.

(56) References Cited

U.S. PATENT DOCUMENTS 4,773,646 A * 9/1988 Joos, Jr. ..... A63F 7/3065 273/121 A
5,346,226 A * 9/1994 Block ..... F41J 1/10 273/388
5,603,505 A * 2/1997 Acock ..... F41J 7/06 273/391
2014/0062023 A1* 3/2014 Burtan ..... F41J 7/04 273/407

* cited by examiner

*Primary Examiner* — Aarti B Berdichevsky
*Assistant Examiner* — Christopher Glenn
(74) *Attorney, Agent, or Firm* — Lee Palmateer Law Office LLC; Lee Palmateer

(57) ABSTRACT

A dynamic target stand comprising pivotally interconnected platform members including two horizontal parallel swing arms pivotally mounted to a base on two vertical parallel pivot posts and a plurality of horizontal cross members pivotally connected to both swing arms on vertical pivot axes. A motor drives the swing arms in reciprocating clockwise and counterclockwise motion. The cross members travel in reciprocating arcuate paths but maintain a fixed angular (or rotational) orientation with respect to a person taking target practice. Targets mounted to the swing may face the user's line of sight throughout their arcuate paths. Multiple targets may be mounted on the platform creating a dynamic group of targets moving at different speeds, in different lateral directions, and crossing paths from the user's perspective. The target stand is compact, portable by person, and rapidly set up and taken down without tools.

13 Claims, 7 Drawing Sheets

DYNAMIC GROUP TARGET STAND

TECHNICAL FIELD

The present invention relates to target devices, and more particularly to a mechanized dynamic target stand.

BACKGROUND OF THE INVENTION

People take target practice for development of shooting skills, for recreations and for sport. Mechanized target devices that provide moving targets can make target practice more challenging and more fun. They are also useful tools for weapons training and tactical training for military, paramilitary, and law enforcement personnel. Most target devices do not model dynamic group movement with multiple individual targets moving simultaneously in a group in various combinations of the same and/or different directions; same and/or different speeds; same and/or different depths from the shooter; and other variables.

Target devices suitable for target practice with firearms are typically large devices and require careful, cumbersome set-up. One must typically travel to the location where the target device is installed. Firearm target devices that are portable typically require cumbersome set up operations.

There is a need for a rugged, simple, compact and portable automatic target device which is suitable for shooting with firearms, which provides dynamic group movement, which is easy to set up with little or no tools, which can be carried by a person and easily transported in a typical passenger vehicle or light pick-up truck to a location selected by the user, and which is compatible with a readily available portable power supply such as a car battery.

SUMMARY OF THE INVENTION

In a first aspect, the present invention provides a dynamic target stand for supporting a group of targets comprising a base and a platform comprising a first swing arm rotatably connected to the base at a first pivot connection having a first pivot axis; a second swing arm rotatably connected to the base at a second pivot connection having a second pivot axis parallel to and spaced apart from the first pivot axis; a first cross member rotatably connected to the first swing arm at a third pivot connection, said third pivot connection having a third pivot axis parallel to and spaced apart from the first pivot axis; said first cross member rotatably connected to the second swing arm at a fourth pivot connection having a fourth pivot axis parallel to and spaced apart from the second pivot axis; and wherein said platform is adapted for supporting at least one target so that the target can be presented for target shooting practice.

BRIEF DESCRIPTION OF THE DRAWINGS

The subject matter that is regarded as the invention is particularly pointed out and distinctly claimed in the concluding portion of the specification. The invention, however, may be best understood by reference to the following detailed description of various embodiments and the accompanying drawings in which:

DETAILED DESCRIPTION OF THE INVENTION

The present invention provides an innovative mechanized target device suitable for use in any target shooting application. It is suitable for use with live ammunition from large and small caliber firearms. It uses a minimum of moving parts while providing dynamic side-to-side (or "lateral") target movements of multiple targets at various depths from the shooter. The device provides a variety of target movements simultaneously so that some targets move in the same direction and speed, while others move at different speeds and/or different directions. The targets may be identified as friend or foe so that the shooter is challenged to hit the foe targets without hitting the friend targets. Due to the variety of target depths, speeds, and directions, targets may be obscured by other targets as they move in front of or behind one another. With its unique dual-axis base and its platform comprising dual swing arms and parallel cross members, the device is uniquely capable of maintaining targets in a fixed rotational orientation throughout the range of platform motion.

Figure 1:
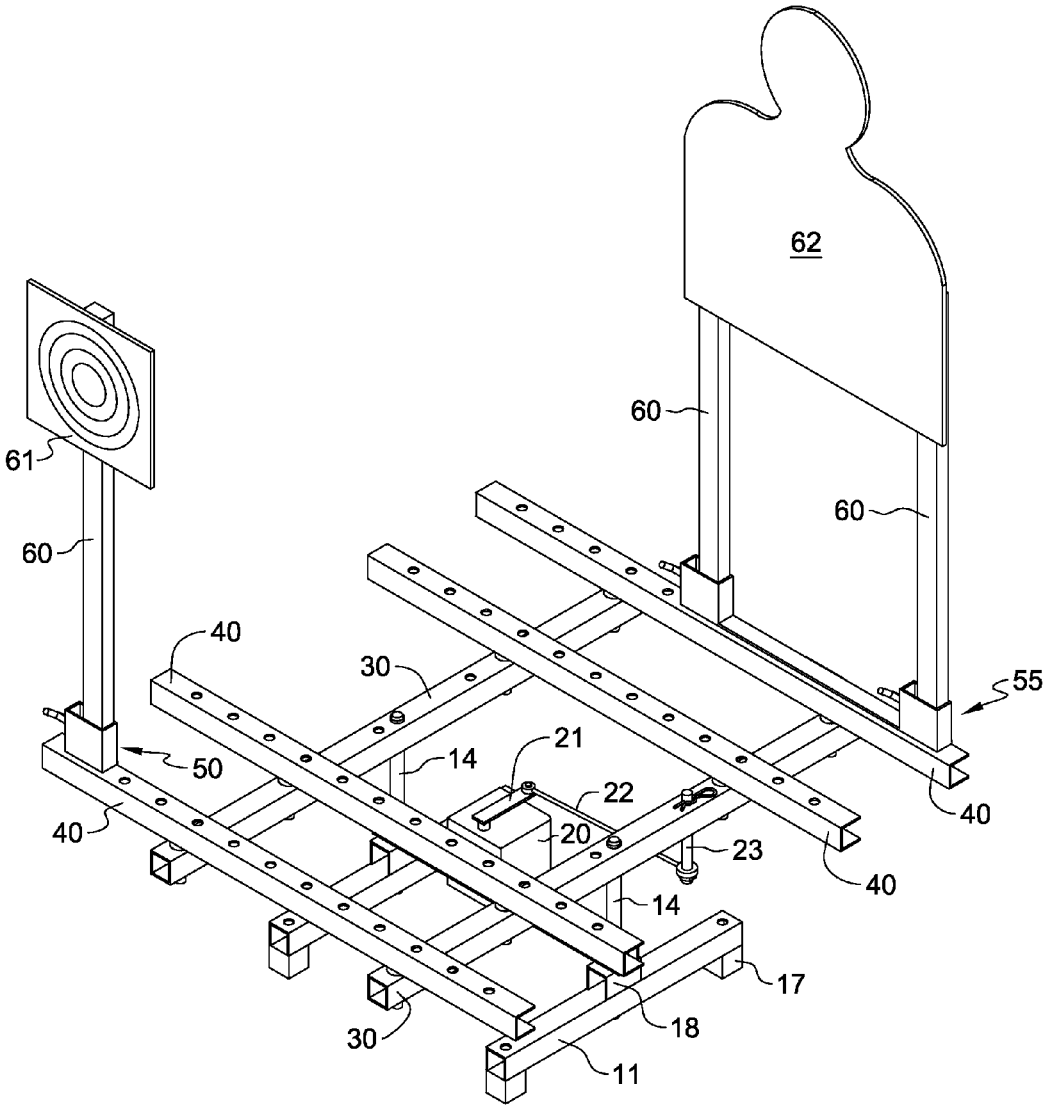
FIG. 1 is a perspective view of a dynamic target device in accordance with the present invention with the target platform in the neutral position.
Figure 2:
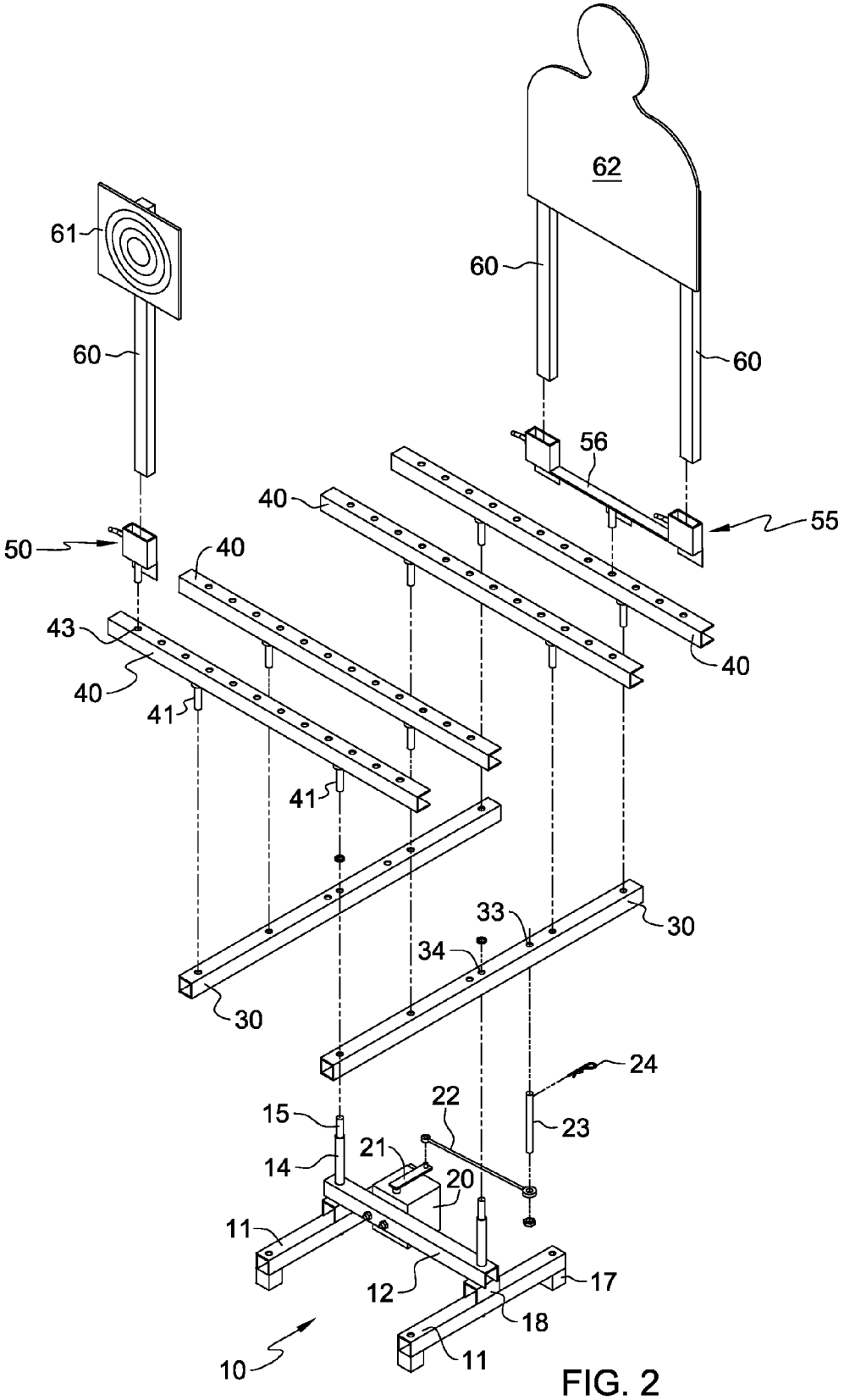
FIG. 2 is an exploded view of the target device of FIG. 1.

FIGS. 1 and 2 show a preferred embodiment of the mechanized target device of the present invention with a base 10, a drive motor 20 attached to the base, and a movable target-support platform, comprising swing arms 30 and cross members 40, that has a dynamically variable geometry. For purposes of enhancing the visibility of the various components, the perspectives of FIGS. 1-5 are from a higher perspective than would be viewed by a person using the device for target practice.

In the preferred embodiment of FIGS. 1 and 2, the moving target platform comprises one elongated swing arm 30 mounted to the base on a first pivot pin 15 of a first pivot post 14, one elongated swing arm 30 disposed parallel to the other swing arm and mounted to the base on a second pivot pin of a second pivot post which is parallel to and laterally disposed from the first pivot post, and a plurality of elongated cross members 30 that each span the distance between the swing arms and are rotatably connected to the swing arms.

Figure 3:
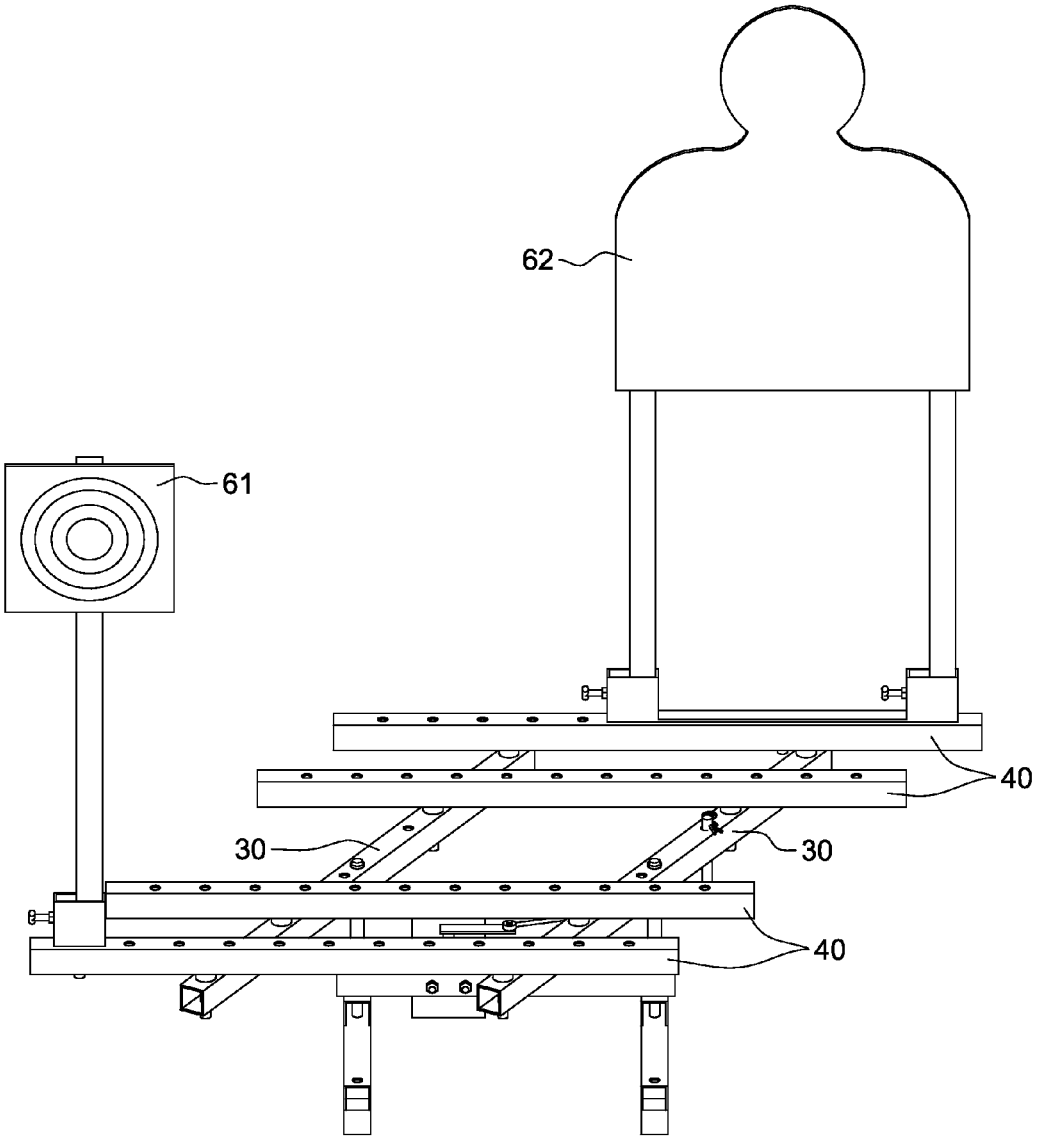
FIG. 3 is another perspective view of the target device of FIG. 1 with the target platform rotated clockwise.
Figure 4:
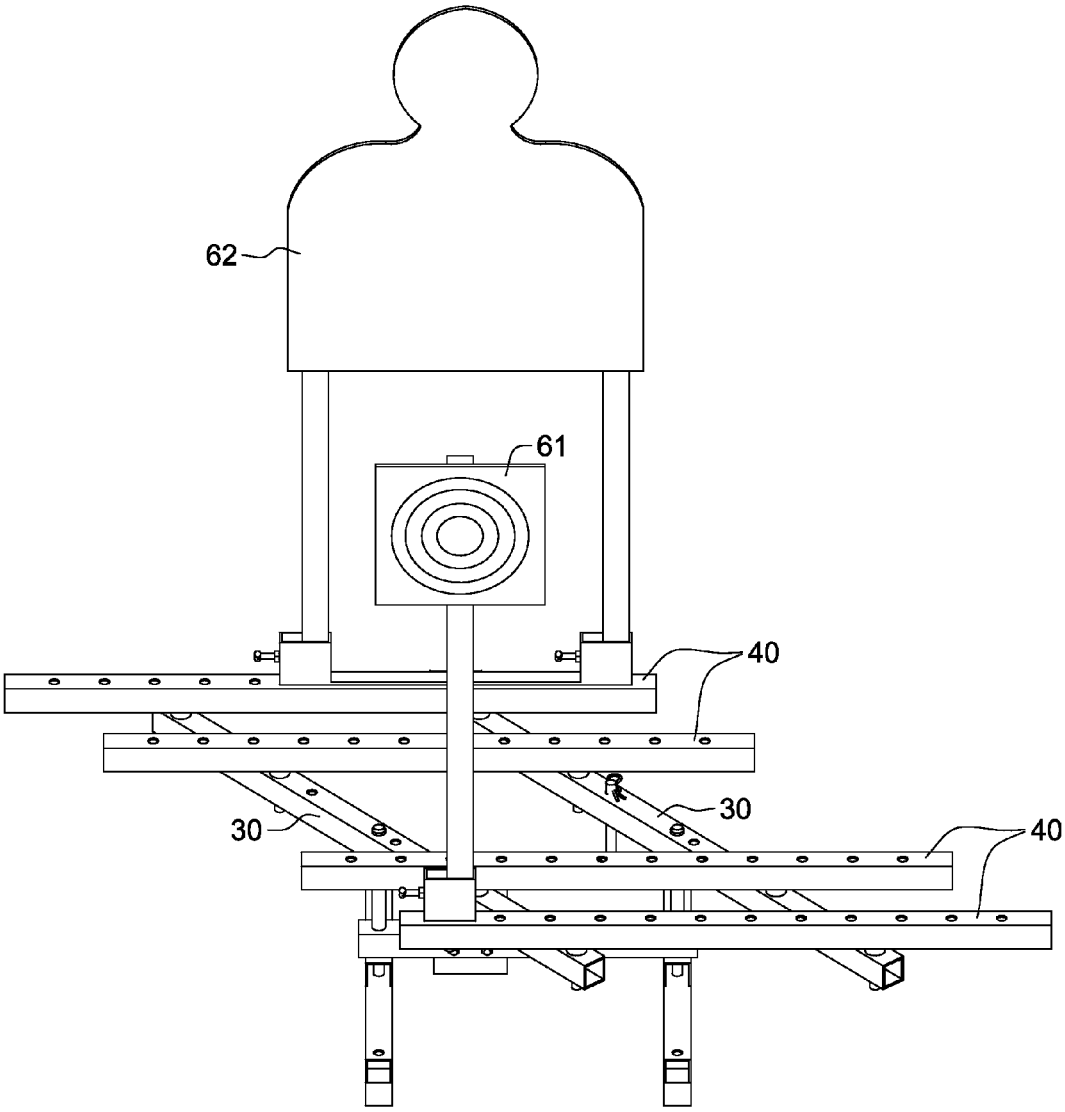
FIG. 4 is another perspective view of the target device of FIG. 1 with the target platform rotated counterclockwise.

Swing arms 30 are rotatable about pivot pins 15. Cross members 40 are each rotatably connected to both swing arms. FIG. 1 shows the platform in neutral position where swing arms 30 are aligned longitudinally parallel with the shooter's line of sight. FIGS. 3 and 4 show the embodiment of FIG. 1 with the target platform at different points in a range of motion, namely a clockwise point and a counterclockwise point, respectively, relative to the neutral point shown in FIG. 1. As described in more detail below, the platform may move back and forth between positions in a reciprocating arcuate motion.

In the preferred embodiment of FIG. 1, the swing arms are disposed parallel to each other and the cross members are disposed parallel to each other. In this parallel arrangement, parallelism among corresponding members is maintained throughout the range of reciprocating arcuate motion. In this parallel arrangement, the rotational orientation of the cross members remains fixed relative to an external reference point so that a cross member of the embodiment of FIG. 1 that is oriented perpendicular to the line of sight of the shooter will remain perpendicular to the line of sight throughout the range of arcuate motion. Thus, a target that is fixed to said cross member will retain its rotational orientation relative to the shooter throughout its movement.

Targets 61 and 62 of FIGS. 1-4 face straight forward and the cross members 40 remain oriented in a lateral orientation, perpendicular to the shooter's line of sight at all three points in the range of motion represented in FIGS. 1-4, and at all points in the range of motion.

Figure 8A:
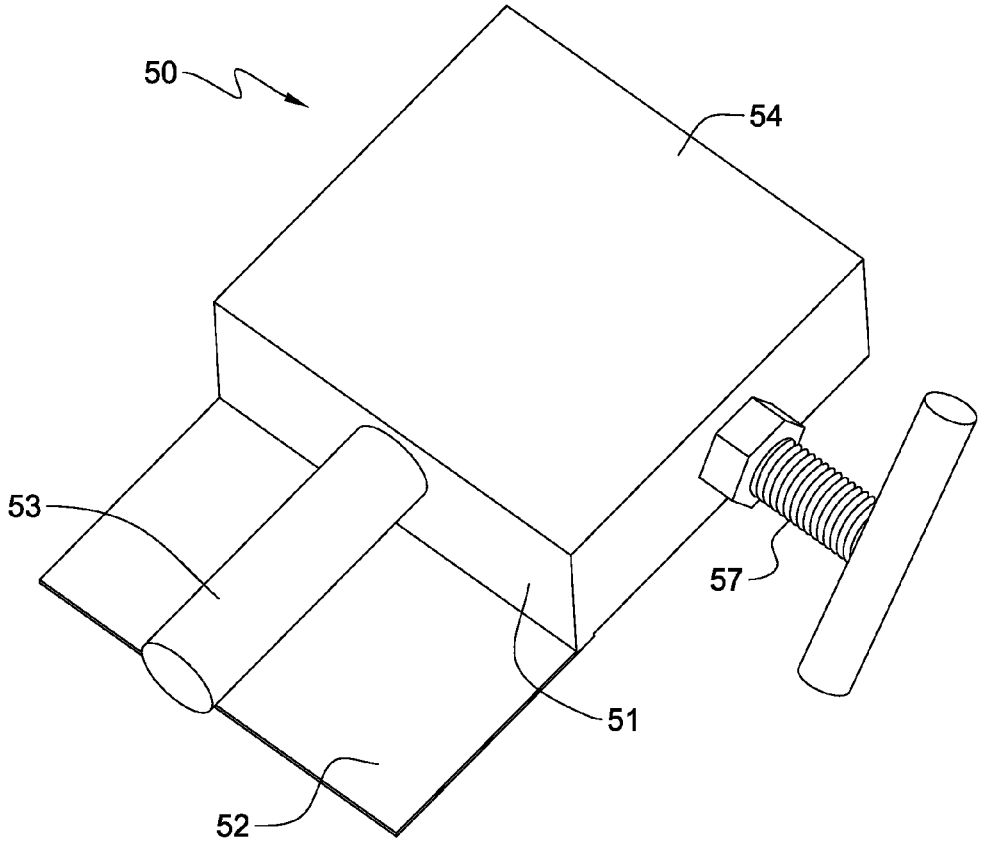
FIG. 8A is a bottom perspective view of a single-post target mount of the present invention.
Figure 8B:
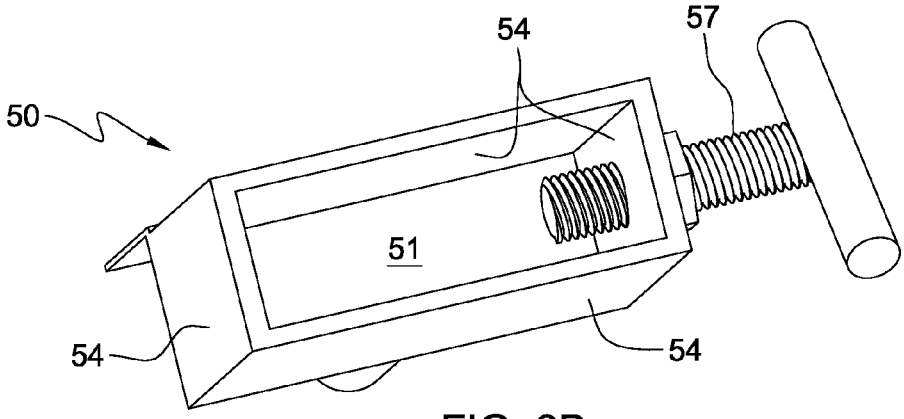
FIG. 8B is a top perspective view of a single-post target mount of the present invention.

In the preferred embodiment of FIGS. 1-4, target 61 is mounted to the forward most cross member and target 62 is mounted to the rearward most cross member. With reference to FIGS. 2, 8A and 8B, targets 61 and 62 are mounted to the cross members using target mounts 50 and 55. With reference to FIGS. 8A and 8B, target mount 50 comprises a flat rectangular base 51, four walls 54 extending upward from the base forming a hollow cavity for receiving a target post, a connector peg 53 downwardly depending from the bottom of base 51 for insertion into a target mount peg hole 43 in a cross member 40, and an alignment flange 52 extending downward from the bottom of the base 51 for contacting the side of cross member 40 to align the mount with the cross member and prevent the mount from rotating relative to the cross member. Peg 53 is long enough to extend at least the entire cross section of the cross member. Target mount 50 has a tapped hole and threaded tightener 57 with corresponding size threads for securing target post 60 in the target in the mount.

Target 61 is attached to an upper portion of target post 60. The lower end of the target post is inserted in the cavity of target mount 50 and held securely in place by turning tightener 57 in the tapped hole to bear down on the side of the post. The threaded tightener may be loosened and tightened as needed to readily change targets so that one target mount can be used with different targets. The tightener may be any threaded tightener such as a wing nut, thumb screw, threaded knob, etc. Alternate embodiments may use any suitable method for affixing targets to platform members.

Target mount 50 is mounted to cross member 40 by aligning alignment flange 52 with the side of the cross member and aligning peg 53 with hole 43 and sliding the peg into the hole. The hole 43 diameter is large enough to accommodate the peg 53 diameter and the distance from peg 53 to alignment flange 52 is large enough to accommodate the distance from hole 43 to the side of cross member 40. Contact between the flange and side of the cross member prevent the target mount from rotating on the cross member. Target mount 50 may be mounted at any hole 43 location.

Target mount 55 comprises two mounts 50 connected with spanning member 56 to form a double-post target mount and operates in the same manner as just described for the single-post mount 55.

In reference to FIG. 2, base 10 comprises two horizontal side legs 11 and cross piece 12 connected to and disposed perpendicularly to the side legs. Spacers 18 are affixed to the legs, such as by welding, and disposed between the legs and cross pieces. Legs 11 have feet 17 attached to their underside at each end. The legs and spacers are joined together with the cross piece by pivot post 14, which has a lower threaded end, and a nut as described more fully below.

With reference to FIGS. 1 and 2, a motor 20 is mounted to cross piece 12. The motor has a rotating drive shaft with a drive arm 21 fixed to and extending radially outward from the drive shaft, and a drive linkage 22 pivotally connected to the drive arm 21 at a distance from the drive shaft and pivotally connected to the platform at a distance from the first pivot axis, i.e., a distance from the pivoting connection between pivot post 14 and swing arm 30. Said first pivot axis is defined by pivot pin 15 and hole 31. Pin 23 is fixed to and extends perpendicularly from linkage 22 and rotatably disposed in a hole 33 in a swing arm 30. Pin 23 and hole 33 define another pivot axis. The top of pin 23 may be adapted with a hole to receive a cotter pin and a cotter pin may be removably disposed therein to prevent separation of the connection. The hole 33 diameter is sized to accommodate the pin 23 diameter so as to form a pivoting connection about which the swing arm and linkage may rotate with respect to one another. Pin 23 is long enough to extend at least the entire cross section of the swing arm.

Drive arm 21 and drive linkage 22 dimensions can be changed to achieve different ranges of motion and different movement characteristics.

As the motor drive shaft and drive arm 21 turn in a continuous rotation, drive linkage 22 drives the swing arm 30 to which it is connected in a reciprocating arcuate motion back and forth between a clockwise most position and a counterclockwise most position. As the swing arms 30 swivel back and forth about their respective axes of rotation at their respective connections with the pivot posts 14 and pivot pins 15, the parts of the swing arms will travel back and forth in arcuate paths. Other platform parts and targets attached thereto will likewise travel back and forth in arcuate paths. From the perspective of a person standing at target practice position in front of the target stand, the motion of platform parts and targets will have a side-to-side component. Using the targets as references to describe the motion, the targets (e.g., target 61 of FIGS. 1-4) located forward of the pivot plane defined by the axes of the two pivot posts 14, i.e., defined by the respective pivot axes of the two swing arms 30, will have a side-to-side motion that is in the opposite direction of the simultaneous side-to-side motion of the targets (e.g., target 62 of FIGS. 1-4) rearward of said plane.

Thus, for example, two targets located at the forward most and rearward most positions on the platform will move in opposite lateral directions at any given time. Starting at the clockwise most platform orientation, the front target may be to the left of the target shooter and the back target may be to the right. As the swing arms move in the counterclockwise direction, the front target moves to the right and the back target moves to the left. If the two targets are mounted mid-span on the cross members, they will converge, cross and then diverge as they each continue until the platform is in the counterclockwise most orientation in which the front target is to the right and the back target is to the left. Thus the front target passes in front of the back target.

The targets may be mounted at various locations along the length of any cross member. Thus there will be many combinations of relative movements. For example, targets located at opposite extremes of their respective cross members might not pass across each other, but instead will approach closer to one another until they change directions and then separate away from each other.

With reference to the platform configurations shown in FIGS. 1-4, Cross members located nearest pivot posts 14 will move more slowly than cross members located further away because their arcuate path of movement has a smaller radius. Thus targets mounted at various distances away from the plane defined by the pivot posts will move at different speeds.

Therefore, with a very simple device of the present invention, including a simple drive train and simple stand design that can be easily assemble in minutes with minimal if any tools, a complex set of dynamic group movements can be achieved. Targets can be readily moved to different locations on the platform. The number, type and location of targets can be easily changed in seconds without any tools.

Target locations can be indexed so that combinations can be recorded and repeated. For example, each swing arm and cross member can be marked with a number or letter and each target mounting hole can be marked with a number. The numbers and or letters can be used as coordinates to designate positions on the platform. An example coordinate convention is "x:y" with "x" indicating the position on the swing arm and "y" indicating the position on the cross member. For example, "position 2:4" would indicate the $4^{th}$ hole from the left on the cross member assembled in the $2^{nd}$ hole forward of the pivot post on the swing arms. Likewise, "position −2:4" would indicate the $4^{th}$ hole of the cross member assembled in the $2^{nd}$ hole behind the pivot post on the swing arms. Another coordinate convention could be based on dimensions, such as "position 12:24" indicating position 24" from the left on the cross member located 12" in front of the pivot posts. Hole numbers, linear dimensions or other coordinate location indicators can be marked on the cross members and swing arms and can be prominently visible to the user. The geometric relations and dimensions of the parts of the target stand, including the base, motor linkages, swing arms, cross members, and targets can be controlled and computed so as to achieve specific predetermined movement characteristics. Motor speeds can be controlled and regulated. Standardization of geometries, rules of use and scoring can be achieved for training and competitive purposes.

Figure 6:
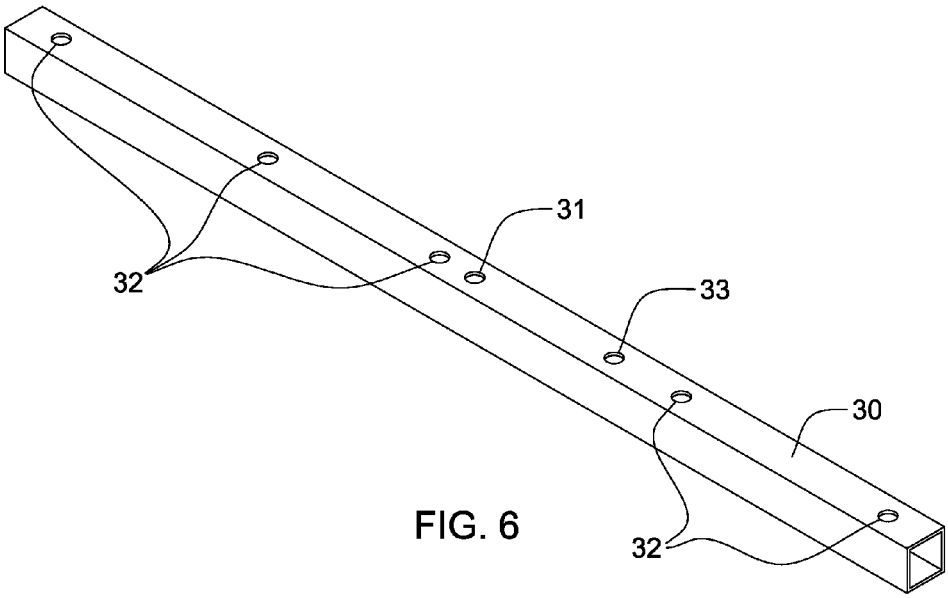
FIG. 6 is a top perspective view of a swing arm of the present invention.

FIG. 6 shows a swing arm 30 of the preferred embodiment of the present invention. In this embodiment, the swing arm comprises a pivot pin hole 31 for receiving a pivot pin 15 of pivot post 14 so that the swing arm can be rotatably assembled to the base 10, a motor linkage connector pin hole 33 for receiving linkage pin 23 so that the swing arm can be rotatably assembled to the motor drive linkage, and a plurality of connector peg holes 32 for receiving cross member connector pegs 41 so one or more cross members 40 can be rotatably assembled to the swing arm. The pivot pin hole 31 diameter is sized to rotatably accommodate pivot pin 15 but smaller than the pivot post 14 diameter so that the bottom of the swing arm rests on the pivot post. Pivot pin 15 is long enough to extend at least the entire cross section of the swing arm.

The swing arm is shown in FIG. 6 as having elongated, square tubular construction, but it can be of any suitable construction and shape. The tubular construction provides the advantage of light weight and stiff construction and is particularly useful for providing sufficient cross section dimension to provide sturdy and stable pin connections with pivot pin 15, drive linkage pin 23 and cross member pegs 41. The tubular construction facilitates longer pins and pegs, and provides for a greater span of engagement with the pins and pegs. In the tubular construction of the preferred embodiment, holes 31, 32 and 33 each comprise concentrically aligned holes in the top and bottom wall of the tubular material.

Figure 7:
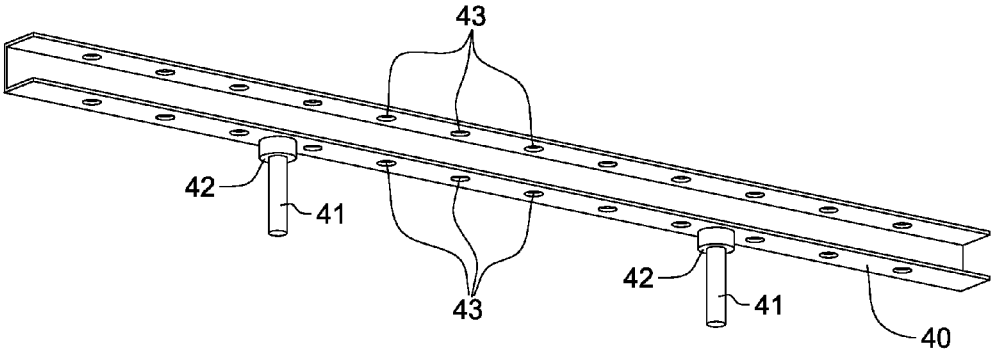
FIG. 7 is a bottom perspective view of a cross member of the present invention.

FIG. 7 shows a cross member 40 of the preferred embodiment of the present invention. In this embodiment the cross member comprises a plurality of target mount peg holes 43 spaced apart over its length for receiving target mount connector pegs 53 so that target mounts can be slidably assembled to the cross member, and two connector pegs 41 for insertion into swing arm connector peg holes 32 so that the cross member can be rotatably assembled to two swing arms 30. The peg 41 diameter is smaller than the hole 32 diameter. Connector pegs 41 have a boss portion with a relatively broad bearing surface 42 for engaging the top surface of swing arm. Cross member 40 is assembled to a swing arm 30 by inserting a peg 41 into a hole 32. The cross member connector pegs 41 of the preferred embodiment are spaced apart a distance equal to the distance between two connector peg holes 32 of the two swing arms 30 shown in FIGS. 1-4 so that the cross member may be assembled to two swing arms. In the preferred embodiment peg 41 is long enough to extend at least the entire cross section of the swing arm.

The cross member is shown in FIG. 7 as having elongated, square u-channel construction, but it can be of any suitable construction and shape. The u-channel construction provides the advantage of light weight and stiff construction and is particularly useful for providing sufficient cross section dimension to provide sturdy and stable pin connections with target mount connector pegs 53. The u-channel construction facilitates longer pegs, and provides for a greater span of engagement with the pegs. In the u-channel construction of the preferred embodiment, holes 43 each comprise concentrically aligned holes in the top and bottom wall of the channel material.

The target mount connector peg 53 may be inserted into any of peg holes 43 on any of the cross members.

Swing arms 30 may also be provided with peg holes for receiving target mount connector pegs or may otherwise be adapted so that targets may be mounted thereon.

In the preferred embodiment, the swing arms 30 easily slide on and off pivot pins 15, drive linkage pin 23 easily slips in and out of hole 33 in the swing arm, cross member pegs 41 easily slip into and out of holes 32 in the swing arms, and target mount connector pegs 53 easily slip in and out of holes 43 in the cross members. Target posts 60 easily slip into and out of the target mounts 50 and 55, although they may be releasably tightened in said mounts via threaded tighteners 57. Thus, the device assembles and disassembles very easily with the aid of little or no tools. The target mount peg 53 preferably has a clearance fit with peg holes 43 but in other embodiments may have a snug fit or interference fit because rotation between the mount and cross member is not a necessary operational feature of the target mount.

In other embodiments, any joint construction that allows relative movement between the joined members through their desired range of movement would be suitable.

Figure 5:
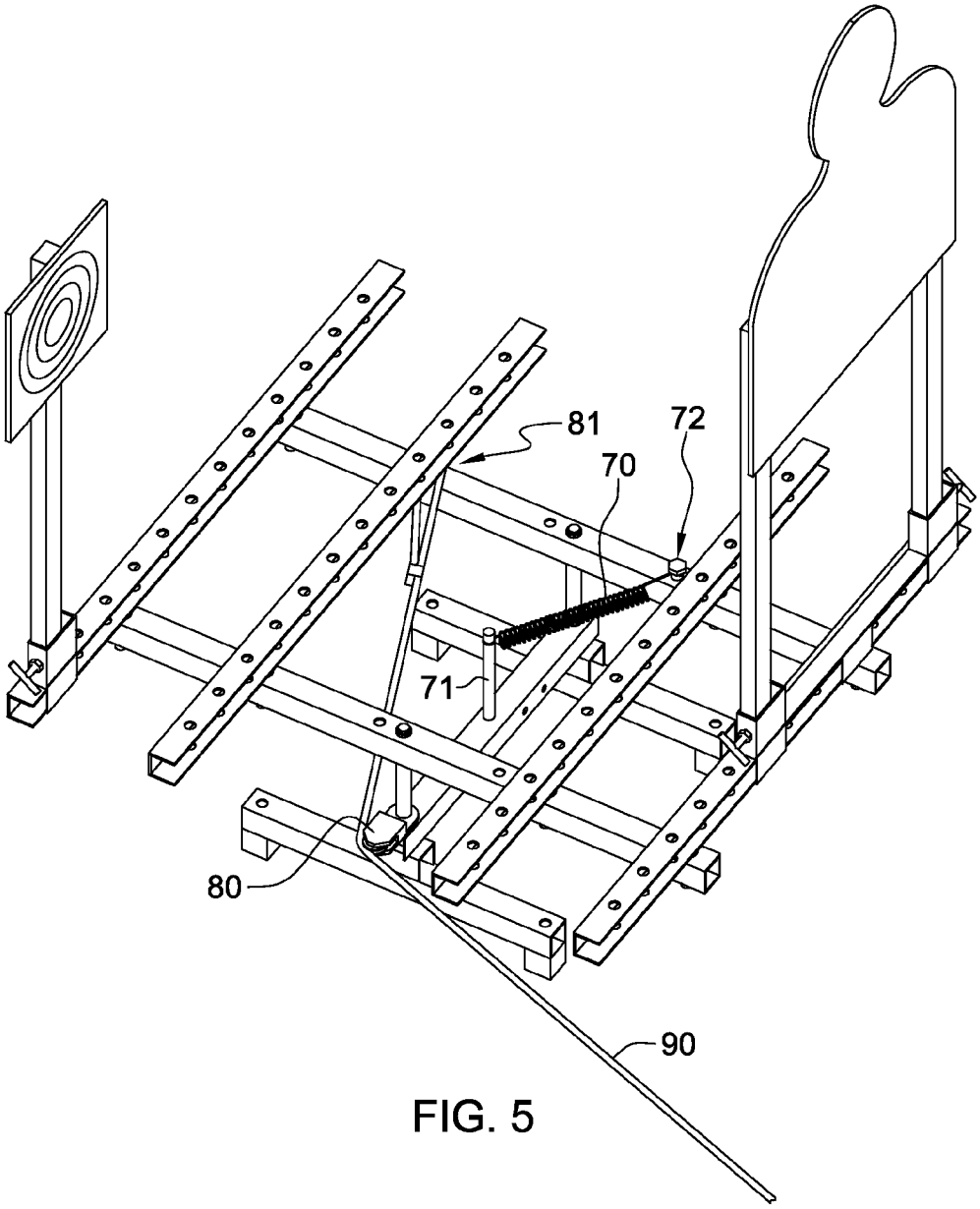
FIG. 5 is another perspective view of another embodiment of the target device of FIG. 1 with an alternate source of motive power.

FIG. 5 shows an alternate embodiment without a motor wherein the source of motive power comprises a line 90 (also referred to herein as a rope) and pulley 80 wherein said pulley is attached to the base, one end of the rope is attached to the platform at connection 81, the other end of the rope is engageable with a pulling source, and the rope passes along the rim of the pulley so that the rope applies a force to the platform when pulled so as to rotate the swing arms about their pivot axes. Spring 70 is connected at one end to the base at connection 71 and at the other end to a swing arm 30 at connection 72 a distance away from the pivot post 14 (see FIGS. 1 and 2) on the opposite side of the pivot post from rope connection 81. The line may be any appropriate line, such as a rope, string, cable, chain, tether, cord, thread, wire, strap or band. By pulling the rope, the rope operator causes the drive swing arm to rotate about its pivot axis defined by pivot post 14 and pivot pin 15 and causes spring 70 to stretch. When rope tension is released, the spring will recoil and rotate the swing arm in the opposite direction. Alternating pulling and releasing causes reciprocating motion similar to that described in connection with the motorized embodiment.

In an alternate embodiment, in lieu of spring 70, a second rope and pulley may be provided with an opposite or different arrangement so as to provide a force when pulled that rotates the swing arms in an opposite direction from the first rope. Reciprocating action is provided by alternately pulling and letting up on the two ropes in coordinated action.

In the preferred embodiment of FIGS. 1-4, in which the platform comprises straight and thin elongated members, the lattice formed by the platform members and pivot posts may define the essential geometric relationships of the present invention. However, alternate embodiments of the present invention may have platform components that are shaped differently than straight elongated shapes. The swing arms and cross members can take on an infinite variety of shapes so long as the geometric relationship of the various axes of rotation or "pivot axes" are as described or inherently disclosed in the preferred embodiment. FIGS. 1-4 show a base having two parallel pivot posts 14 with pivot pins 15, each of which define a pivot axis for a swing arm rotatably connected thereto. The cross members 40 are each rotatably connected to one swing arm 30 at one pivot connection forming a pivot axis and to the other swing arm 30 at another pivot connection forming another pivot axis. In the preferred embodiment show in FIGS. 1-4, the two swing arms are always parallel to one another and the cross members are always parallel to one another. Each cross member 40 has two parallel connecter pegs 41. The distance between the two connector pegs is the same for all cross members. Each connector peg 41 defines a pivot axis for the connection between the cross member 40 and swing arm 30. All of the pivot axes of the preferred embodiment are parallel with one another.

The method of using the device of the present invention is intuitive to one with ordinary skill in the art based on the physical features and configuration of the device itself.

Targets may also be mounted to the swing arms. Such targets that are fixed to the swing arms will maintain their rotational orientation relative to the swing arms, and thus their rotational orientation relative to the shooter will change throughout the range of arcuate motion.

With reference to FIG. 2, pivot post 14 comprises boss section having a diameter greater than the diameter of pivot pin 15. The pivot post extends upward from cross piece 12. Said pivot pin extends upwardly from the pivot post. The pivot post has a threaded lower end portion that has a smaller diameter than the boss section, thus defining a lower boss shoulder with a downward facing surface (not shown). Cross piece 12, spacer 18 and leg 11 are provided with holes (not shown) for receiving said threaded lower end. The diameter of the hole in said cross member is smaller than said boss diameter. The threaded lower end of pivot post 14 is inserted though the cross member, spacer and leg, and the lower boss shoulder surface rests on the top surface of cross piece 12. The threaded lower end extends below leg 11 a sufficient length to receive a threaded nut (not shown). Said nut is tightened on the threaded lower end of the pivot post against the bottom of leg 11, forming a joint between said parts. Said joint between the cross piece 12, leg 11 and pivot post 14 may be tightened to desired tightness. To permit compact stowage configuration, the joint may be rotatable with application of sufficient force by hand so that the two legs 11 of base 10 can be pivoted into near alignment with the longitudinal direction of the cross piece 12. Thus base 10 can be collapsed into compact configuration for compact stowage.

In FIGS. 1-4, motor 20 may be a DC motor, an AC motor, or any other suitable source of motive power. The source of motive power (or "motor") may be adapted for connection with an electrical power source and may be compatible with readily available portable power supplies such as a car battery.

While the invention has been particularly shown and described with reference to certain embodiments, it will be understood by those skilled in the art that various changes in form and details may be made to the invention without departing from the spirit and scope of the invention as described in the following claims.

I claim:

1. A dynamic target stand for supporting a group of targets comprising:

a base; and a platform comprising a first swing arm rotatably connected to the base at a first pivot connection having a first pivot axis;

a second swing arm rotatably connected to the base at a second pivot connection having a second pivot axis parallel to and spaced apart from the first pivot axis;

a first cross member rotatably connected to the first swing arm at a third pivot connection, said third pivot connection having a third pivot axis parallel to and spaced apart from the first pivot axis;

said first cross member rotatably connected to the second swing arm at a fourth pivot connection having a fourth pivot axis parallel to and spaced apart from the second pivot axis;

wherein the fourth pivot axis is located the same radial distance and angular coordinate from the second pivot axis as the third pivot axis is from the first pivot axis; and a second cross member rotatably connected to the first swing arm at a fifth pivot connection, said fifth pivot connection having a fifth pivot axis parallel to and spaced apart from the first pivot axis;

said second cross member rotatably connected to the second swing arm at a sixth pivot connection, said sixth pivot connection having a sixth pivot axis parallel to and spaced apart from the second pivot axis;

wherein the sixth pivot axis is located the same radial distance and angular coordinate from the second pivot axis as the fifth pivot axis is from the first pivot axis; and wherein said platform is adapted for supporting at least one target so that the target can be presented for target shooting practice.

2. The dynamic target stand of claim 1 further comprising: a source of motive power connected to the platform to oscillate the first swing arm back and forth about the first pivot axis between a first and second angular position.

3. The dynamic target stand of claim 1 further comprising at least one target mounted to at least one of the cross members.

4. The dynamic target stand of claim 1 further comprising at least one target mounted to at least one of the swing arms.

5. The dynamic target stand of claim 1 wherein the third, fourth, fifth and sixth pivot axes are located on the same side of a plane defined by the first and second pivot axes.

6. The dynamic target stand of claim 1 wherein the third and fourth pivot axes are located on the same side of a plane defined by the first and second pivot axes and wherein the fifth and sixth pivot connections are located on the other side of said plane.

7. The dynamic target stand of claim 2 wherein the source of motive power comprises:

an electric motor having a rotating drive shaft;

a drive arm fixed to and extending radially outward from the drive shaft;

and a drive linkage pivotally connected to the drive arm at a distance from the drive shaft and pivotally connected to the platform at a distance from the first pivot axis.

8. The dynamic target stand of claim 2 wherein the source of motive power comprises a line and pulley wherein said pulley is attached to the base, one end of the line is attached to the platform, the other end of the line is engageable with a pulling source, and the line passes along a rim of the pulley so that the line applies a force to the platform when pulled so as to rotate the swing arms about their pivot axes.

9. The dynamic target stand of claim 8 wherein the source of motive power further comprises a spring attached to the platform so as to oppose the force applied to the swing arms by the line so that the line and spring cooperate to oscillate the swing arms back and forth in rotating motion.

10. The dynamic target stand of claim 1 wherein the swing arms and cross members are straight elongated members oriented perpendicularly to their respective axes of rotation.

11. The dynamic target stand of claim 10 wherein:

the base comprises a first and second pivot pin;

the first swing arm comprises at least one pivot hole for receiving a pivot pin and at least one peg hole for receiving a cross member peg;

the second swing arm comprise at least one pivot hole for receiving a pivot pin and at least one peg hole for receiving a cross member peg;

the first cross member comprises at least one peg for engaging at least one of said cross member peg holes; and the first pivot connection comprises the first pivot pin inserted in the first swing arm pivot hole, the second pivot connection comprises the second pivot pin inserted in the second swing arm pivot hole, the third pivot connection comprises a cross member peg inserted in a cross member peg hole of the first swing arm, and the fourth pivot connection comprises a cross member peg inserted in a cross member peg hole of the second swing arm.

12. The dynamic target stand of claim 11 wherein the first cross member further comprises at least one target support hole for receiving a target support peg.

13. The dynamic target stand of claim 11 wherein at least one of the first and second swing arms further comprises at least one target support hole for receiving a target support peg.

* * * * *